US010539370B2

(12) United States Patent
Sampaio

(10) Patent No.: US 10,539,370 B2
(45) Date of Patent: Jan. 21, 2020

(54) VACUUM CONDENSATION SYSTEM BY USING EVAPORATIVE CONDENSER AND AIR REMOVAL SYSTEM COUPLED TO CONDENSING TURBINES IN THERMOELECTRIC PLANTS

(71) Applicant: CITROTEC INDÚSTRIA E COMÉRCIO LTDA, Araraquara (BR)

(72) Inventor: Paulo Henrique Sampaio, Araraquara (BR)

(73) Assignee: CITROTEC INDÚSTRIA E COMÉRCIO LTDA, Araraquara (BR)

( * ) Notice: Subject to any disclaimer, the term of this patent is extended or adjusted under 35 U.S.C. 154(b) by 57 days.

(21) Appl. No.: 15/775,416

(22) PCT Filed: Nov. 11, 2015

(86) PCT No.: PCT/IB2015/058711
§ 371 (c)(1),
(2) Date: May 11, 2018

(87) PCT Pub. No.: WO2016/042538
PCT Pub. Date: Mar. 24, 2016

(65) Prior Publication Data

US 2019/0072332 A1 Mar. 7, 2019

(51) Int. Cl.
*F28B 1/06* (2006.01)
*F28B 9/02* (2006.01)
(Continued)

(52) U.S. Cl.
CPC ..... *F28B 1/06* (2013.01); *F28B 9/02* (2013.01); *F28B 9/08* (2013.01); *F28B 9/10* (2013.01); *F28D 5/02* (2013.01); *F28B 2001/065* (2013.01)

(58) Field of Classification Search
CPC ..... F28B 9/00; F28B 9/02; F28B 9/04; F28B 9/08; F28B 9/10; F28B 1/00; F28B 1/02;
(Continued)

(56) References Cited

U.S. PATENT DOCUMENTS 3,148,516 A * 9/1964 Kals ..... F28B 1/02 62/305
3,831,667 A * 8/1974 Kilgore ..... F01K 9/003 165/96
(Continued)

FOREIGN PATENT DOCUMENTS

CN 202250270 U 5/2012
CN 203177688 U 9/2013
(Continued)

OTHER PUBLICATIONS

International Search Report and Written Opinion dated Mar. 22, 2016 of corresponding application No. PCT/IB2015/058711; 7 pgs.
(Continued)

*Primary Examiner* — Mark A Laurenzi
*Assistant Examiner* — Xiaoting Hu
(74) *Attorney, Agent, or Firm* — Maier & Maier, PLLC

(57) ABSTRACT

A VACUUM CONDENSATION SYSTEM BY USING EVAPORATIVE CONDENSER AND AIR REMOVAL SYSTEM COUPLED TO CONDENSING TURBINES IN THERMOELECTRIC PLANTS, made of stainless steel, metal alloys or other materials. This condensing system includes an evaporative condenser, air removal ejector system and condensers, turbine exhaust steam collector system with pipelines, collection and return systems of the condensate to the boiler. The exhaust steam generated in the turbine is driven by steam collector system, condensed in the evaporative condenser, and the air is removed from the
(Continued)

system by the air removal (ejectors) and the condensed air is returned to the boiler by the condensed system.

6 Claims, 15 Drawing Sheets

(51) Int. Cl.
*F28B 9/08* (2006.01)
*F28B 9/10* (2006.01)
*F28D 5/02* (2006.01)

(58) Field of Classification Search
CPC ..... F28B 1/06; F28B 2001/065; F28D 5/00; F28D 5/02; F01K 9/00; F01K 9/003; F25B 39/04; F25B 2339/041; F25B 2339/047; F25B 2600/17
See application file for complete search history.

(56) References Cited

U.S. PATENT DOCUMENTS

| | | | | |
|---|---|---|---|---|
| 3,881,548 | A | 5/1975 | Budenholzer | |
| 4,156,349 | A | 5/1979 | Silvestri, Jr. | |
| 4,252,752 | A * | 2/1981 | Flandroy | F28B 1/06 165/175 |
| 4,443,389 | A * | 4/1984 | Dodds | F28B 1/06 138/38 |
| 4,506,508 | A | 3/1985 | Coers et al. | |
| 4,517,804 | A | 5/1985 | Ura et al. | |
| 4,517,805 | A * | 5/1985 | Kals | F28B 1/00 60/657 |
| 4,903,491 | A * | 2/1990 | Larinoff | F28B 1/06 165/111 |
| 4,905,474 | A * | 3/1990 | Larinoff | F28B 1/06 165/111 |
| 5,355,943 | A * | 10/1994 | Gonano | F28B 1/06 165/112 |
| 6,128,901 | A | 10/2000 | Sha | |
| 6,233,941 | B1 | 5/2001 | Youssef | |
| 2008/0006395 | A1 * | 1/2008 | Sanderlin | F28B 1/02 165/110 |
| 2010/0229553 | A1 | 9/2010 | Smith | |
| 2014/0034273 | A1 | 2/2014 | Shi Honghui et al. | |
| 2014/0209279 | A1 * | 7/2014 | Aaron | F28D 5/02 165/104.13 |

FOREIGN PATENT DOCUMENTS

| | | | |
|---|---|---|---|
| KR | 20100057573 | A | 5/2010 |
| WO | 2011067619 | A2 | 6/2011 |

OTHER PUBLICATIONS

International Preliminary Report on Patentability dated Mar. 21, 2017 of corresponding application No. PCT/IB2015/058711; 4 pgs.

* cited by examiner

VACUUM CONDENSATION SYSTEM BY USING EVAPORATIVE CONDENSER AND AIR REMOVAL SYSTEM COUPLED TO CONDENSING TURBINES IN THERMOELECTRIC PLANTS

FIELD

This patent document refers to an automated and efficient system resulting from the combination of exhaust steam collector, steam pipes, self-sufficient evaporative condenser or condensers with low energy consumption and air ejectors to remove the air from the equipment. This combination of interconnected equipment promotes the vacuum condensation of the exhaust steam of the turbine with low energy consumption, more specifically, it has the technical effect of vacuum application (low pressure), creating one more effect on the rotors of the turbines in thermoelectric plants as a way to improve the heat efficiency using the energy of the steam with low temperature and pressure until the condensation.

BACKGROUND

Currently the cogeneration of energy at thermoelectric of sucroenergetics plants has gained a lot of credibility, once the biomass is burned in boilers that produce steam, replacing non-renewable fuel sources, such as natural gas and coal. The process of cogeneration of electricity through biomass burning has been one of the great products of sucroenergetics plants, but efficiency (ratio of kg-steam/MW) of the systems is the main objective of the process. Conventional procedures of condensation of turbine exhaust steam has a relatively high energy consumption when comparing with the system required as inventive herein may be attributed to the fact that modern systems are basically composed of a hull/cooled pipe condenser for recirculated water in a cooling tower.

The cogeneration of power, besides supplying the power supply of the plant itself, it generates surpluses that are sold, making it a profitable product for sucroenergetics plants. This process begins with the burning of biomass in boilers of high-pressure steam that is directed to the turbines, this steam moves the solitary rotors of the axle and at the end of the axle there is a generator that converts mechanical energy into electricity. The steam that comes off the boiler and is injected into the turbine has high pressure in overheating conditions, in this form the steam moves a set of rotors in series, having its pressure and temperature reduced until the turbine exhaust. Ideally to take advantage of the vapor pressure energy in the turbine it is necessary to reduce the pressure to the absolute vacuum thereby achieving the maximum yield of the process. This is only possible with the use of capacitors in the turbine exhaust steam and ejector system.

A need of the steam cycle is in the treated water recovery (steam condensate) this process generates a cost and a long worktime at thermoelectric plants. Because of these factors there is a need to condense the vapors to feed back with treated water the boilers that produce driving steam (high pressure steam). The required system integrates this recycling of condensed water in the evaporative condenser with the water being supplied to the boiler, keeping the principle of the reuse of treated water.

The energy consumption of the conventional system of exhaust steam condensation that uses a hull/tube condenser and cooling towers exceeds by 70% the system required in this document. Since there is a need in this process to condense the steam, in Brazil and in other countries there have been the development of cooling tower associated with a condenser hull-tube, but this process generates a high consumption of energy to move the cooling water of the hull/tube condenser and from the cooling tower.

In low temperature countries it is used the dry condensers ("air coolers") composes of a hull/tube condenser associated to a dry cooling tower to condensate the turbine exhaust steam, in this case the power used in the condensation is directly linked to the consumption of energy by the heat exhaust. While this cooling technology apparently demands low power consumption it has a larger physical structure and it inhibits the installation of such systems in tropical countries when compared to the system described herein.

The evaporative condenser used to condense the vapor and generate vacuum in the required turbine, takes advantage of the latent heat of evaporation of water in the environment and through the air movement over the wet tube bundles promote the effect of "wet bulb temperature" cooling the tubular capacitor. The wet bulb temperature is the lowest temperature that can be reached only by the evaporation of water in the environment. It is the temperature that you feel when your skin is wet and is exposed to moving air.

The search carried out in patent banks required to present patented documents of different cooling systems of turbine condensation exhaust steam of thermoelectric.

The North American patent document U.S. Pat. No. 3,831,667 entitled COMBINATION WET AND DRY COOLING SYSTEM FOR A STEAM TURBINE discloses a cooling system that combines wet and dry action for an axial flow steam turbine, with a portion of exhaust steam of the turbine being condensed by cooling water that circulates through a hull/tube condenser cooled by a cooling tower; and having another portion of the exhaust steam condensed by cooling liquid circulated in a tube heat exchanger with fins, in which heat from the cooling liquid is transferred to the air and the cooling liquid is passed through the tubes extended through the condenser, or the cooling liquid is sprayed directly at the condenser to provide a mixture of condensation, thereby the refrigeration system with water cooling towers is smaller than dry cooling towers.

Another North American patent document U.S. Pat. No. 4,156,349 titled DRY COOLING POWER PLANT SYSTEM discloses a system for thermoelectric plants that combine the action of a condenser or cooling tower of air refrigeration (dry). Although this system is used to condense the thermoelectric turbine exhaust steam it presents an entirely different inventive concept of the system as compared to system presented herein this document.

The North American patent document U.S. Pat. No. 3,881,548 titled MULTI-TEMPERATURE CIRCULATING WATER G SYSTEM FOR A STEAM TURBINE reveals a condensing system that uses a cooling tower in multiple stages to provide multi-temperature of the water circulation for one or more condensers, and thus allowing a greater heat transfer in the cooling tower for condensing of the exhaust steam.

The Chinese patent document CN203177688 (U) titled EFFICIENT WATER RING VACUUM PUMP SYSTEM FOR CONDENSING STEAM TURBINE UNIT reveals a utility model of a vacuum condensing system in order to improve the mechanical efficiency of the steam turbine. The vacuum condensing system is composed of a boiler, a steam condensing turbine, a generator, a steam condenser, an improved absorption heat pump, a cooling tower, a low temperature heating device, an exhaust heat collector and a vacuum pump. Even though this invention presents a vacuum condensation by positioning equipment without series and sequence as an innovation, the power used to power the cooling towers, vacuum pump and the entire system is significantly greater than the power consumed by the herein presented system.

The Chinese patent document CN202250270 (U) titled STEAM TURBINE CONDENSING SYSTEM discloses a utility model of a system for condensing exhaust steam of a condensation turbine, which has a compressor, a heater, an expansion relief, and a steam condenser.

The patent document WO 2011067619 titled HYBRID COOLING SYSTEM discloses a hybrid cooling system for condensing the exhaust steam of a steam turbine that reveals a cooling system of the dry cooling circuit, a unit of air cooled by dry air that performs the heat dissipation of the cooling water. According to the invention, the cooling water circulating in the dry refrigeration circuit is separated from the cooling water that circulates in the moist cooling circuit, and the dry and wet cooling circuits are connected to a common condenser.

The North American patent document U.S. Pat. No. 6,233,941 titled CONDENSATION SYSTEM reveals a condensing system for condensing turbine exhaust steam that uses together a surface condenser and a direct contact condenser. The system combines a hybrid cooling tower that combines the wet-dry action. According to the invention it has the advantages that the manufacturing costs of the installation condenser be reduced by reducing the heating tube surface, the power of the turbine is increased by reducing the condenser pressure caused by the hybrid cooling tower.

The Korean patent document KR20100057573 titled THE CONDENSING SYSTEM FOR STEAM TURBINE USING REFRIGERANT EVAPORATION HEAT discloses a system for condensing the turbine exhaust steam that has a steam condenser in which the cooling liquid circulates, a condenser that condenses the refrigerant gas generated in the vapor condenser, a cooling fluid tank, the condensed refrigerant liquid in the condenser and a pump. A cooling circuit of the cooling liquid is formed by a steam condenser, a cooling fluid tank and pumps that supply fluid through tubes connected in a closed circuit.

Another North American patent document US 2014034273 titled EPAVORATIVE CONDENSER RADIATING MODULE FOR STEAM EXHAUST OF A STEAM TURBINE discloses an evaporative condenser for condensing turbine exhaust steam that has a bundle of tubes and steam chambers.

As presented herein exhaust vapor condensation technology and application of vacuum on the rotors of the turbines in thermoelectric plants presents a growing development, but the efficiency of these vacuum condensation equipment is questionable.

Aimed at developing a vacuum condensation system more efficient the inventors developed this invention particularly for applying at thermoelectrics plants which solves some drawbacks caused by currently available systems.

SUMMARY

In order to improve the efficiency of thermoelectric plants it has been developed the vacuum condensation system coupled to turbines, which uses condensation to reduce the pressure increasing the effects of turbine (efficiency). This system is coupled to the turbine in order to condense the steam and generate vacuum in the rotors along the turbines. The efficiency of this system is in the low power consumption used for the operation of this system, thus increasing the liquid energy cogeneration and consequently increasing profitability.

The positive characteristics of this system compared to the present equipment found in the market is in the low energy consumption, low operation and maintenance costs, greater liquid power in the generation, it can be produced in modules, eliminates the need for cooling towers, compact installation and low water consumption.

In a brief description VACUUM CONDENSATION SYSTEM BY USING EVAPORATIVE CONDENSER AND AIR REMOVAL SYSTEM COUPLED TO CONDENSING TURBINES IN THERMOELECTRIC PLANTS is the result from the combination of steam collector, steam duct, condensate tank, evaporative condenser with exhauster, recirculation system, ejectors and condenser ejectors. These devices placed in series and in sequence have the technical effect of the condensation of the vacuum exhaust steam in the rotors along the turbine (opposite direction of the steam flow). This system is distinguished in the efficiency of the evaporative condenser that performs condensation of the entire exhaust steam in a simple structure; composed of an exhauster to circulate air through a wet tube bundle, taking advantage to carry out the condensation. The system of spraying and recirculation of water conducts the wetting of the tube bundles and ejector system to remove the air from the system.

DETAILED DESCRIPTION

Figure 1A:
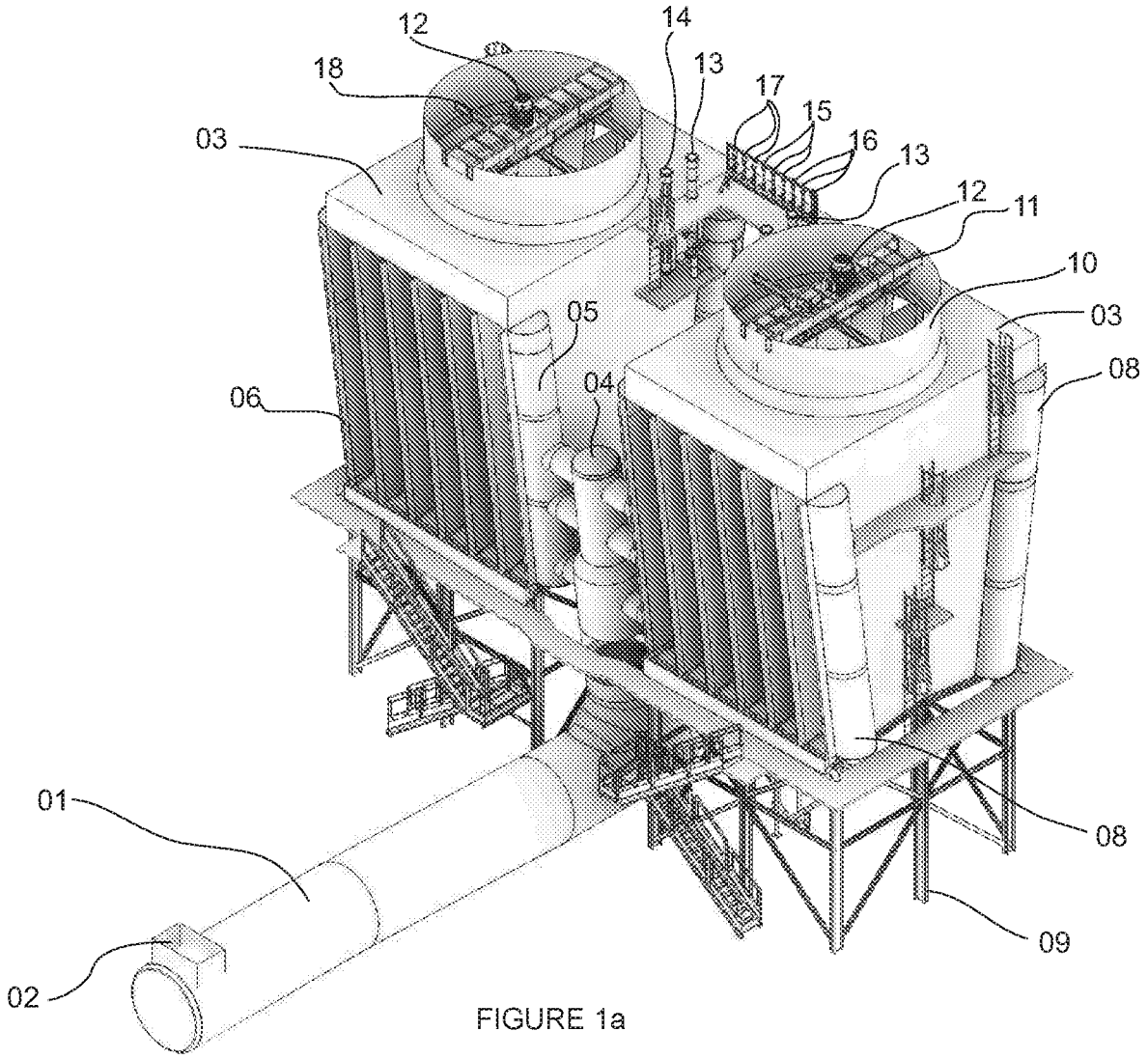
FIG. 1*a*: isometric view of vacuum condensation system.
Figure 1B:
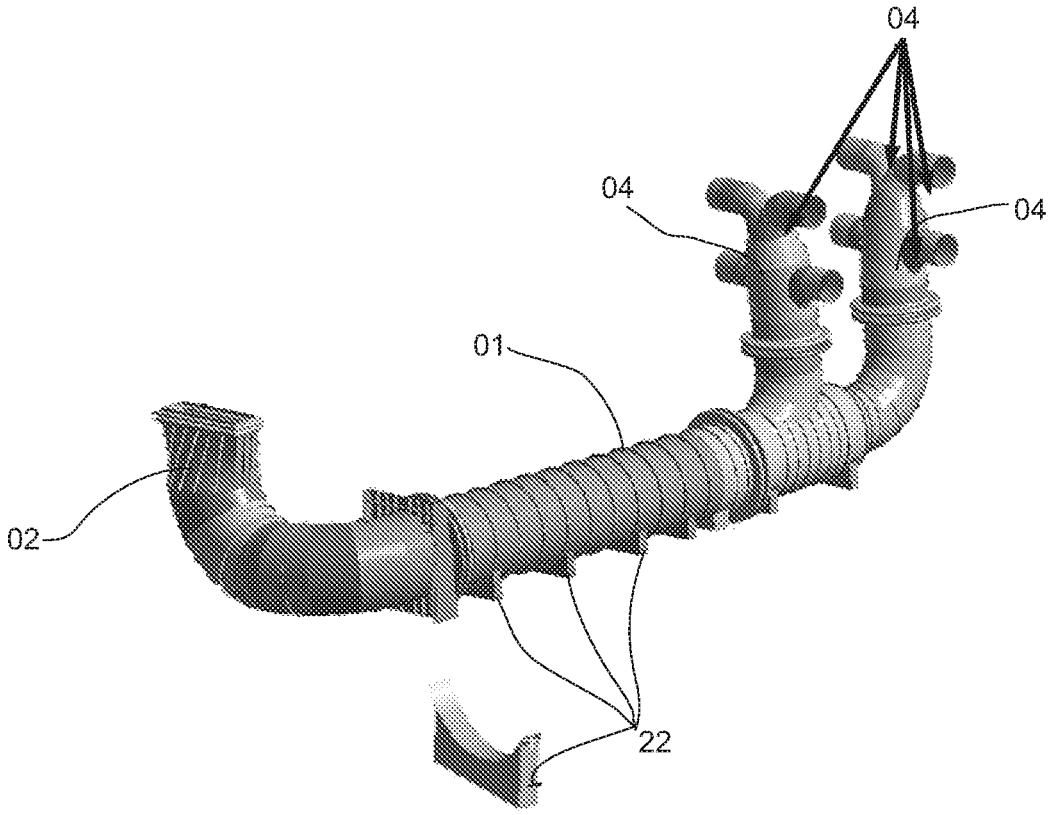
FIG. 1*b*: isometric view of the steam duct that integrates the turbine in the evaporative condenser.
Figure 2:
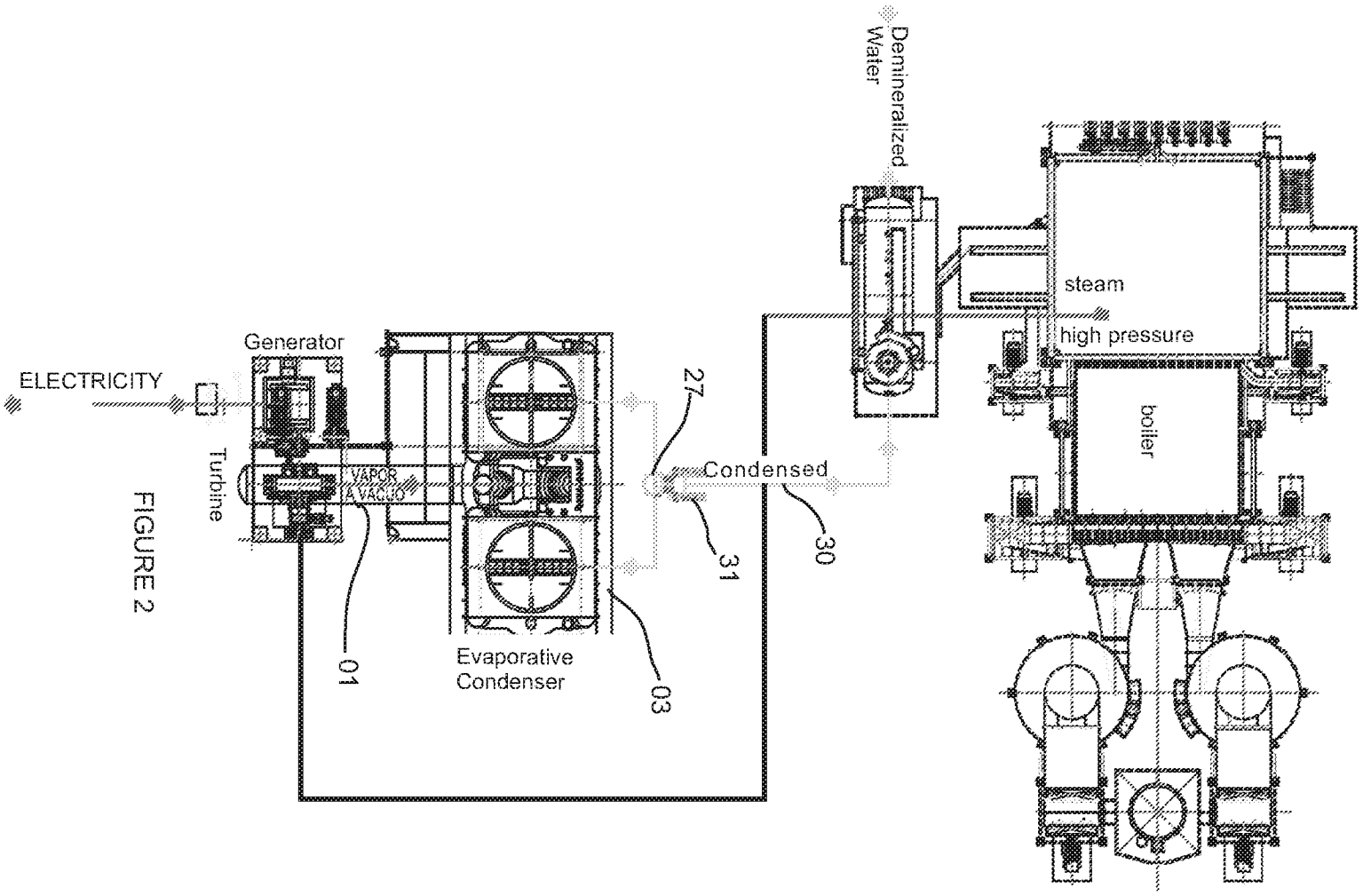
FIG. 2: top view of the cogeneration energy system using the vacuum condensation system to condensate the exhaust steam.
Figure 3:
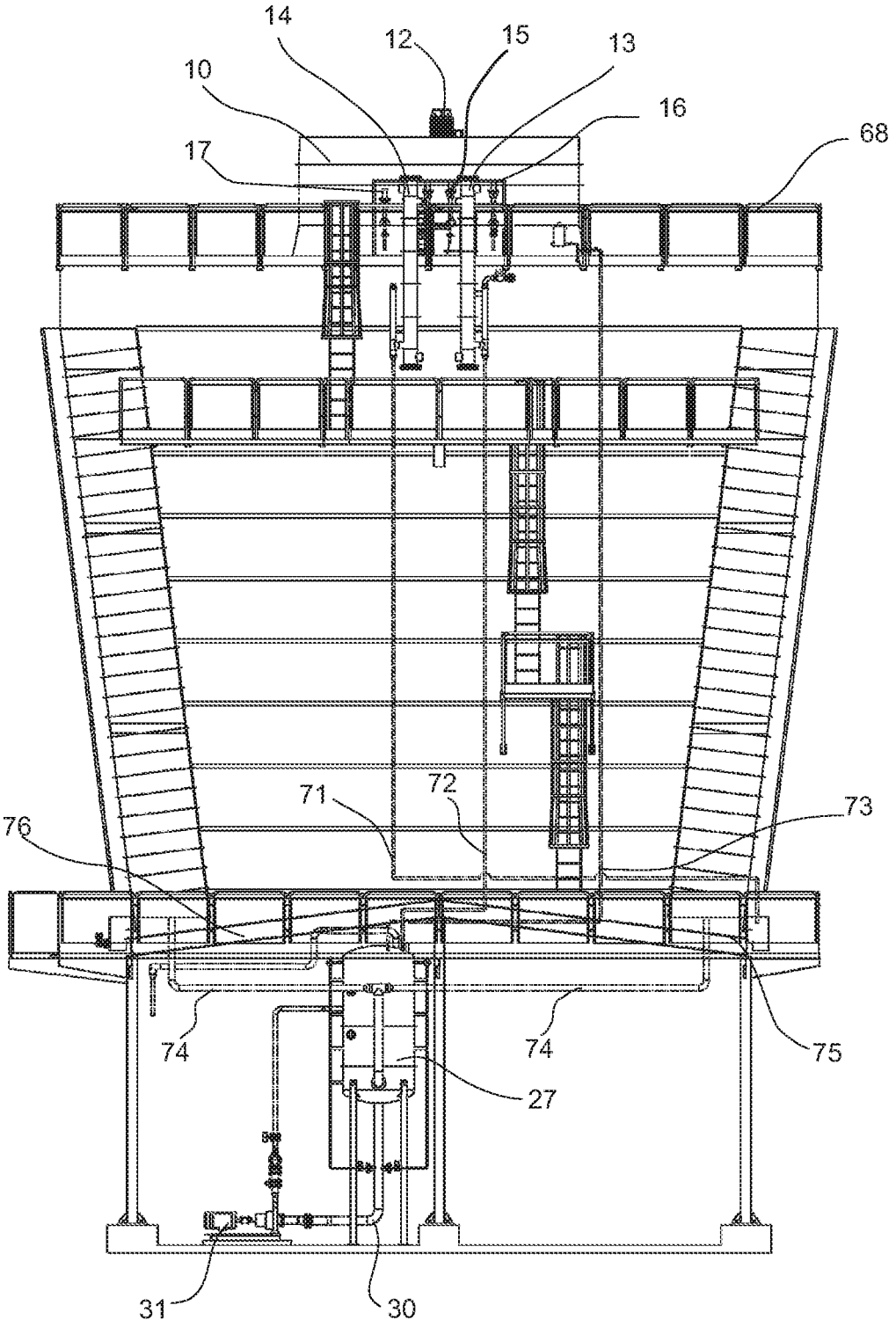
FIG. 3: side view of the vacuum condensation system showing the components of the capture of the exhaust steam condensed.
Figure 4A:
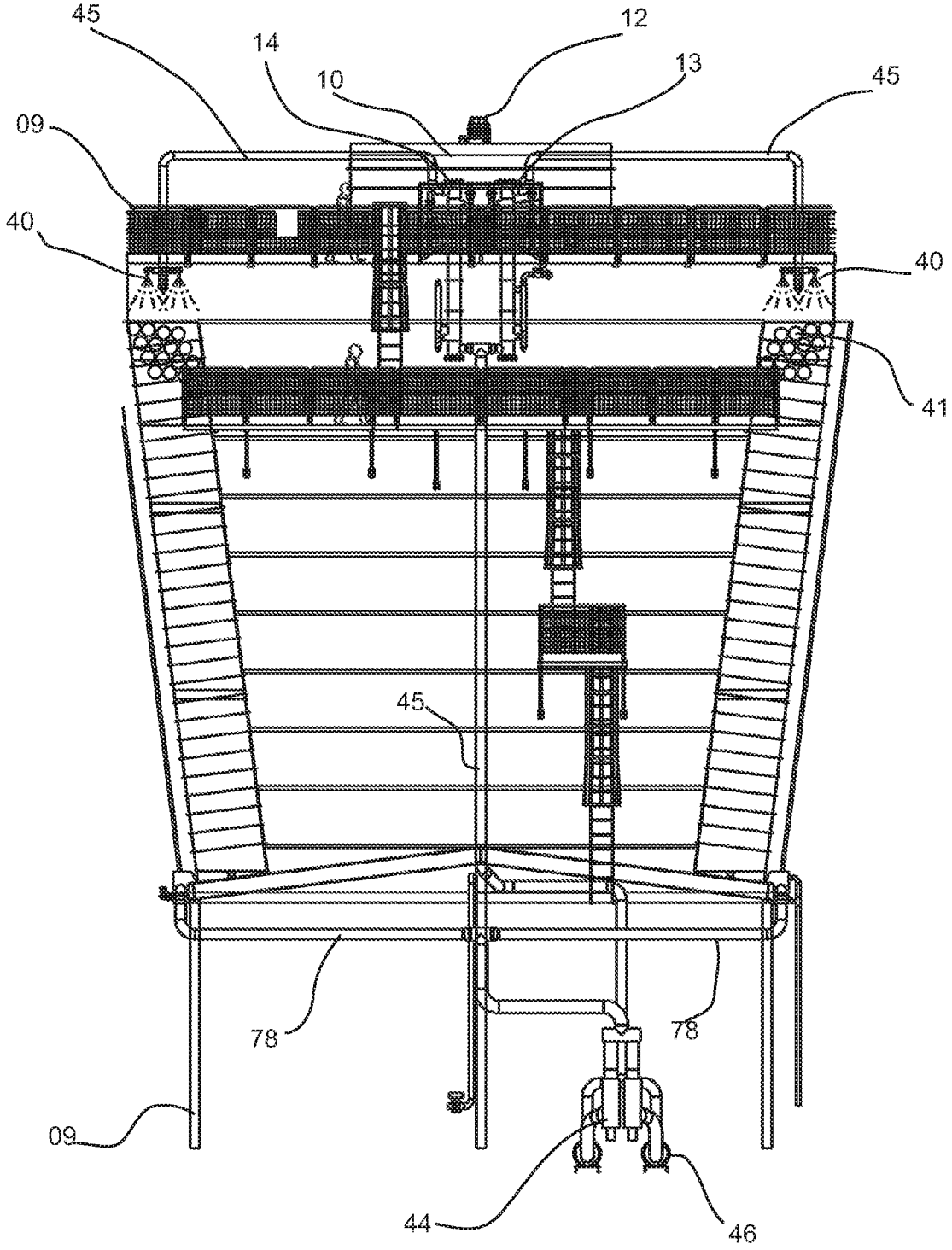
FIG. 4: side view of the vacuum condensation system showing the components of the water recycling system.
Figure 4B:
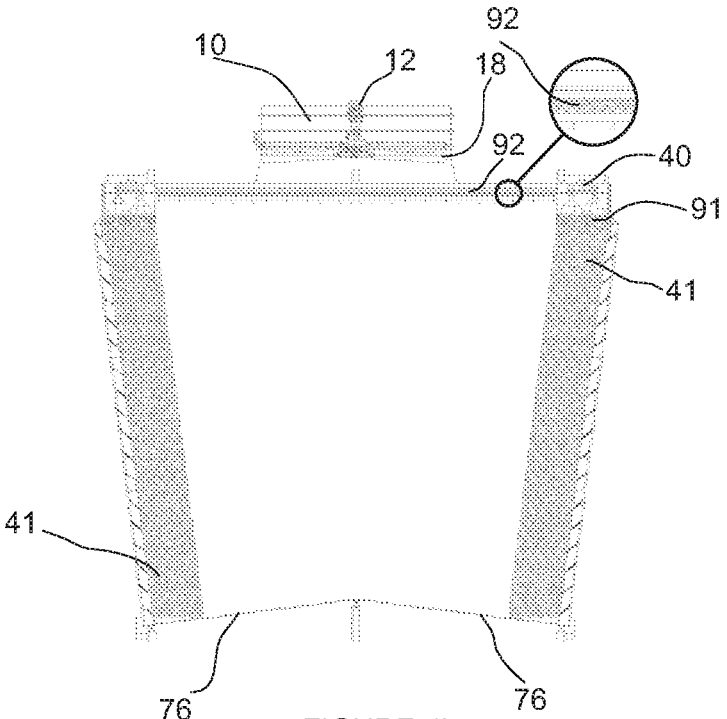
Figure 5:
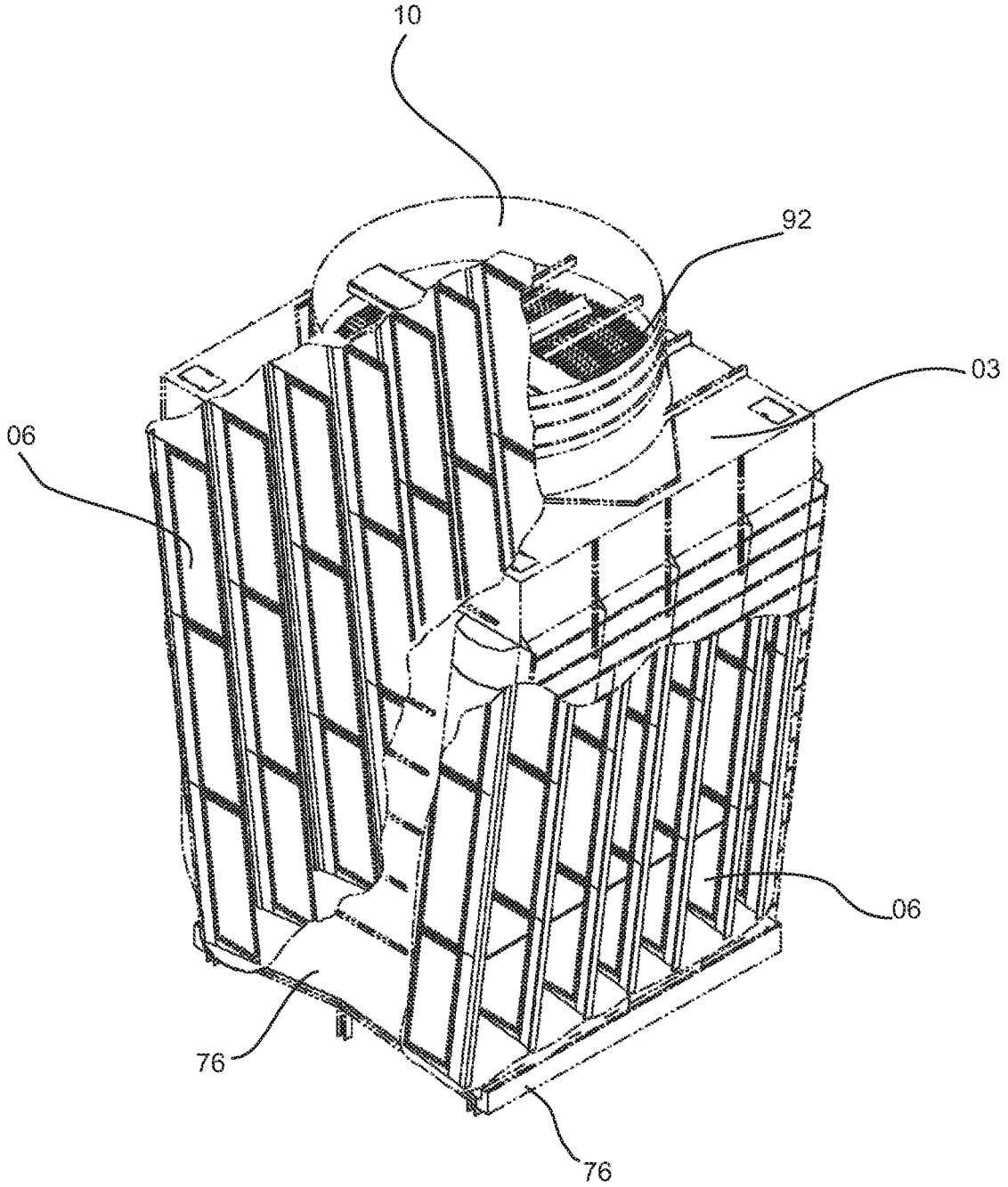
FIG. 5: isometric view with the cut of the evaporative condenser showing the baffles.
Figure 6A:
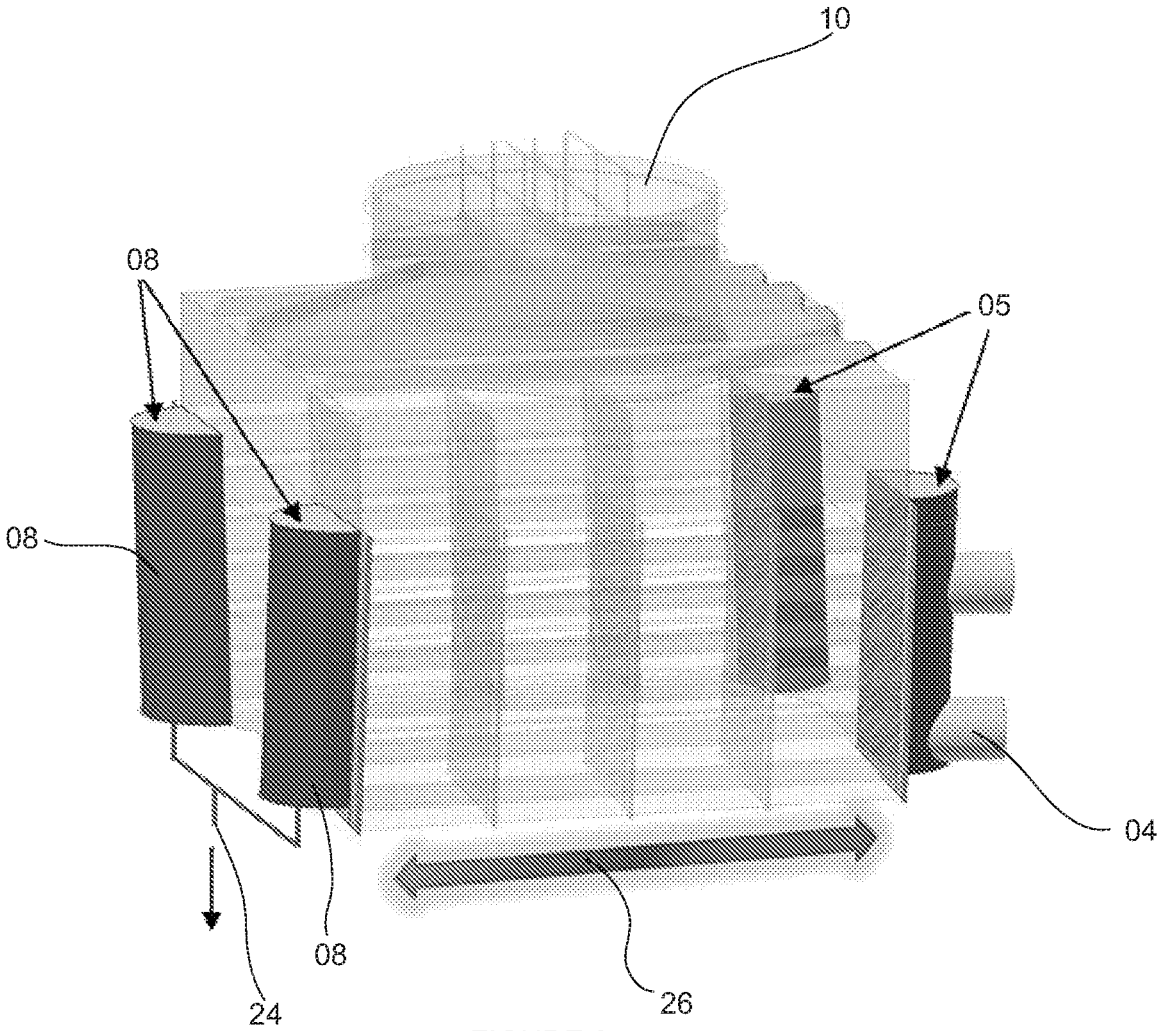
FIG. 6*a*: isometric view with a cut of the evaporative condenser showing the input of the steam and the exit of the condensed, as well as an indication of the steam flow (26).
Figure 6B:
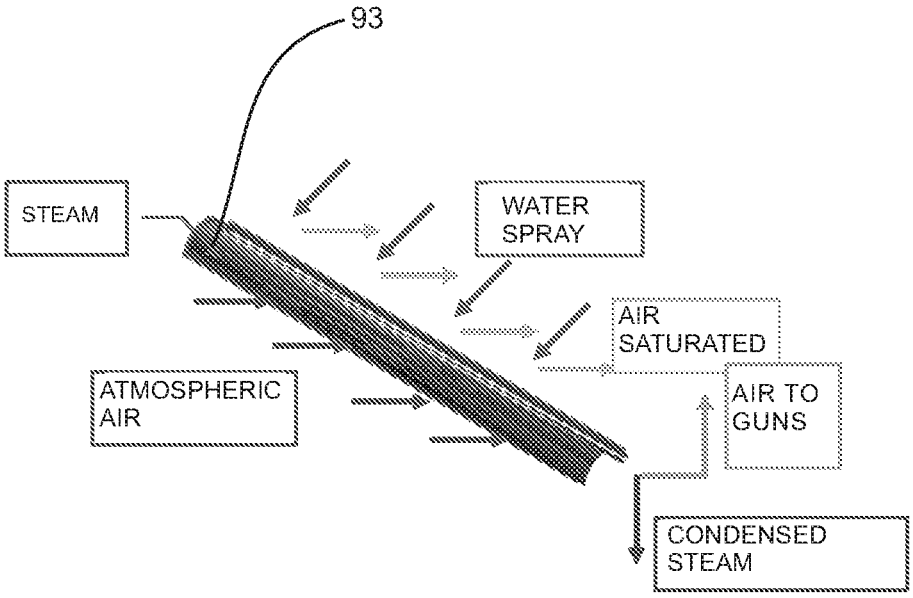
FIG. 6*b*: isometric view of the tube representing the condensation that happens in the tubular pipe bundle (41) of the evaporative condenser.
Figure 7:
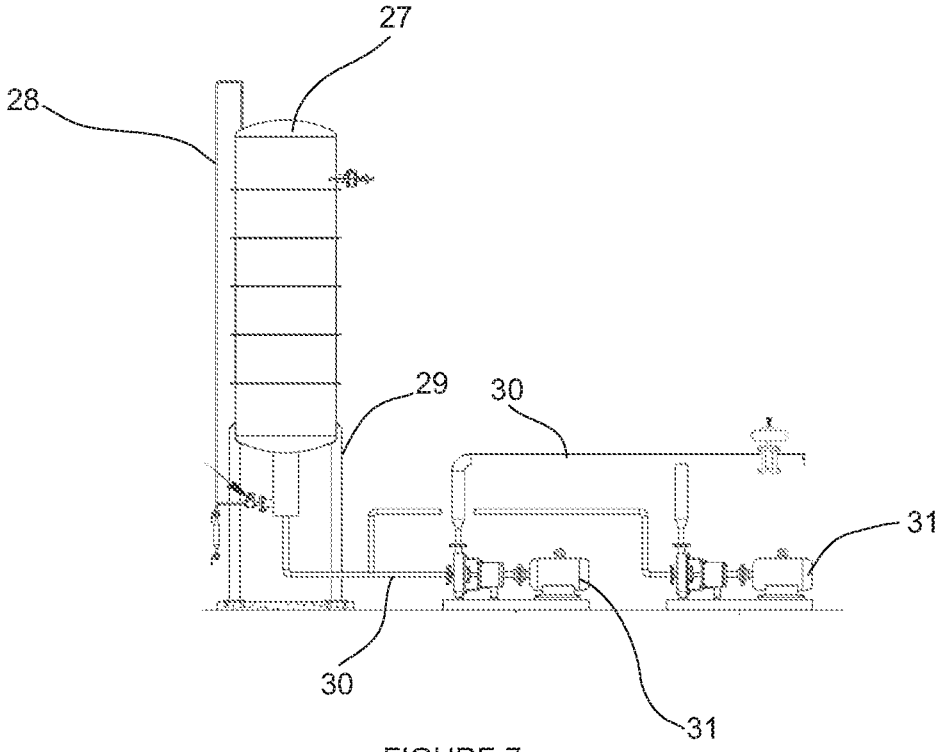
FIG. 7: top view of the condensed tank system and condensed pumps.
Figure 8A:
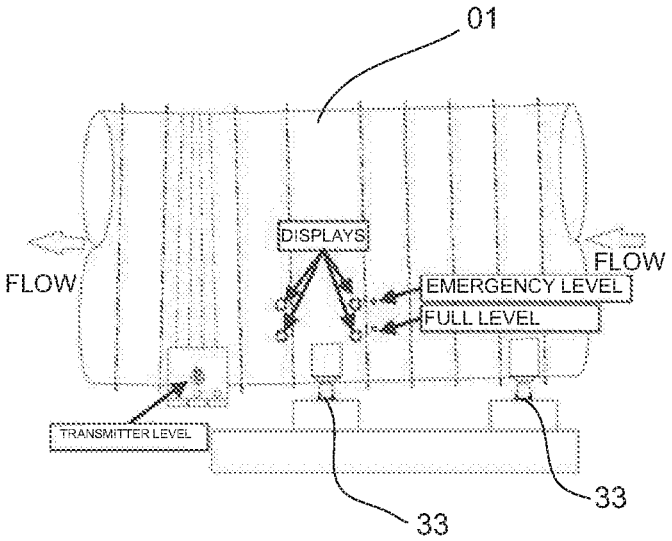
FIG. 8*a*: side view of the steam duct representing the level sensors.
Figure 8B:
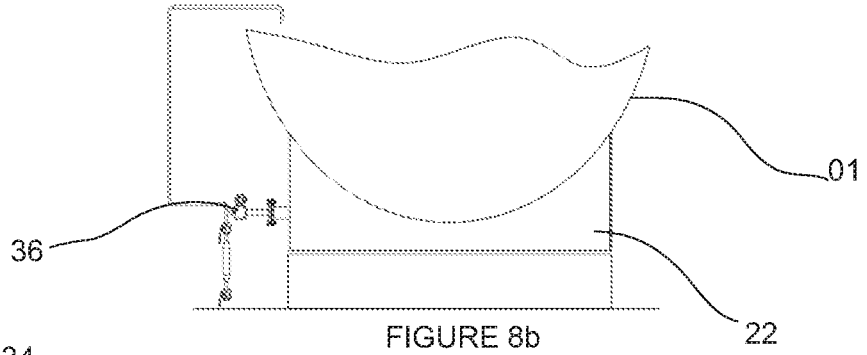
FIG. 8*b*: front view with a cut of the steam duct representing the level transmitter.
Figure 8C:
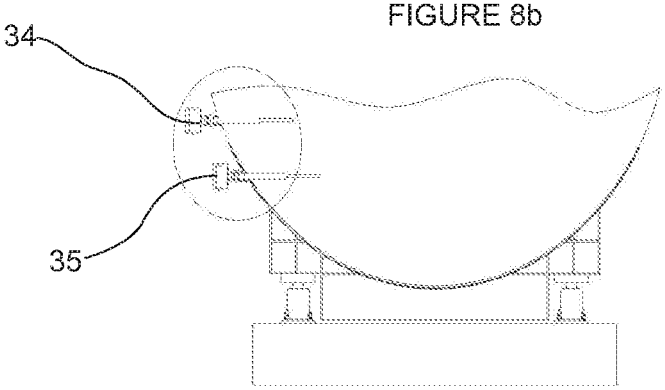
FIG. 8*c*: front view with a cut of the steam duct representing the level sensors.
Figure 9:
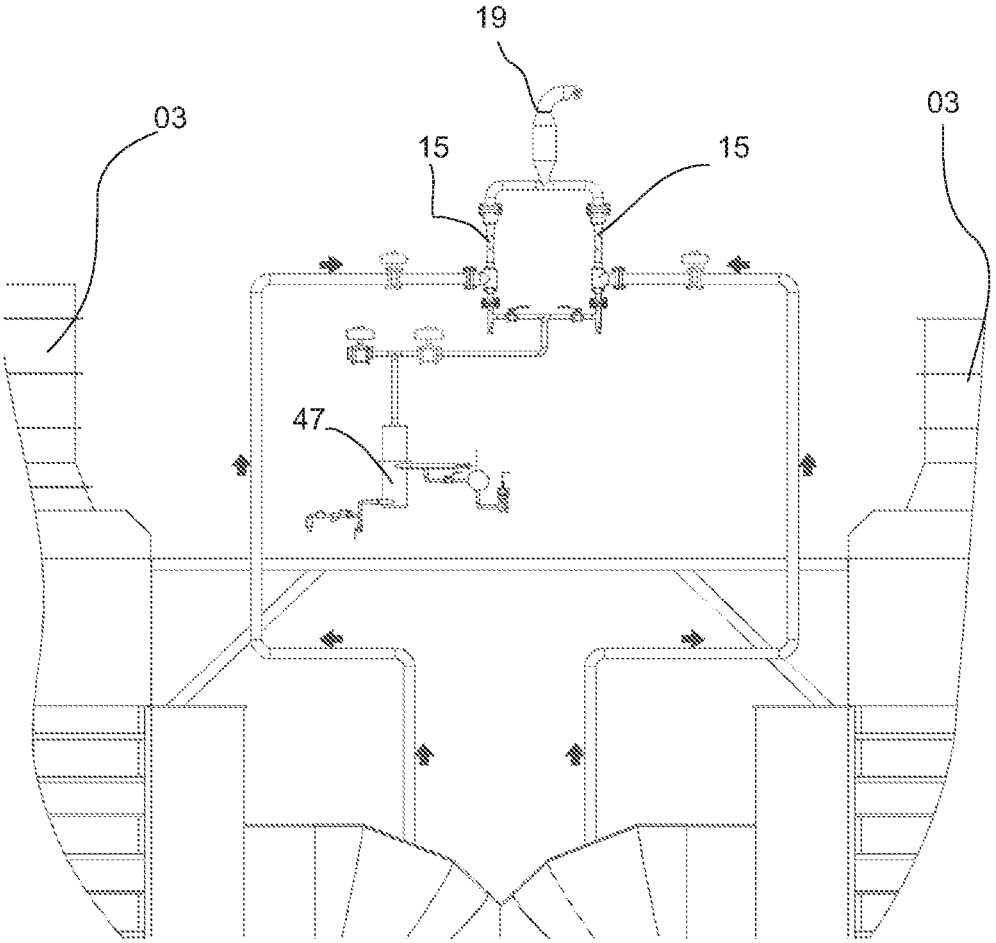
FIG. 9: detailed view showing the system starting ejectors.
Figure 10:
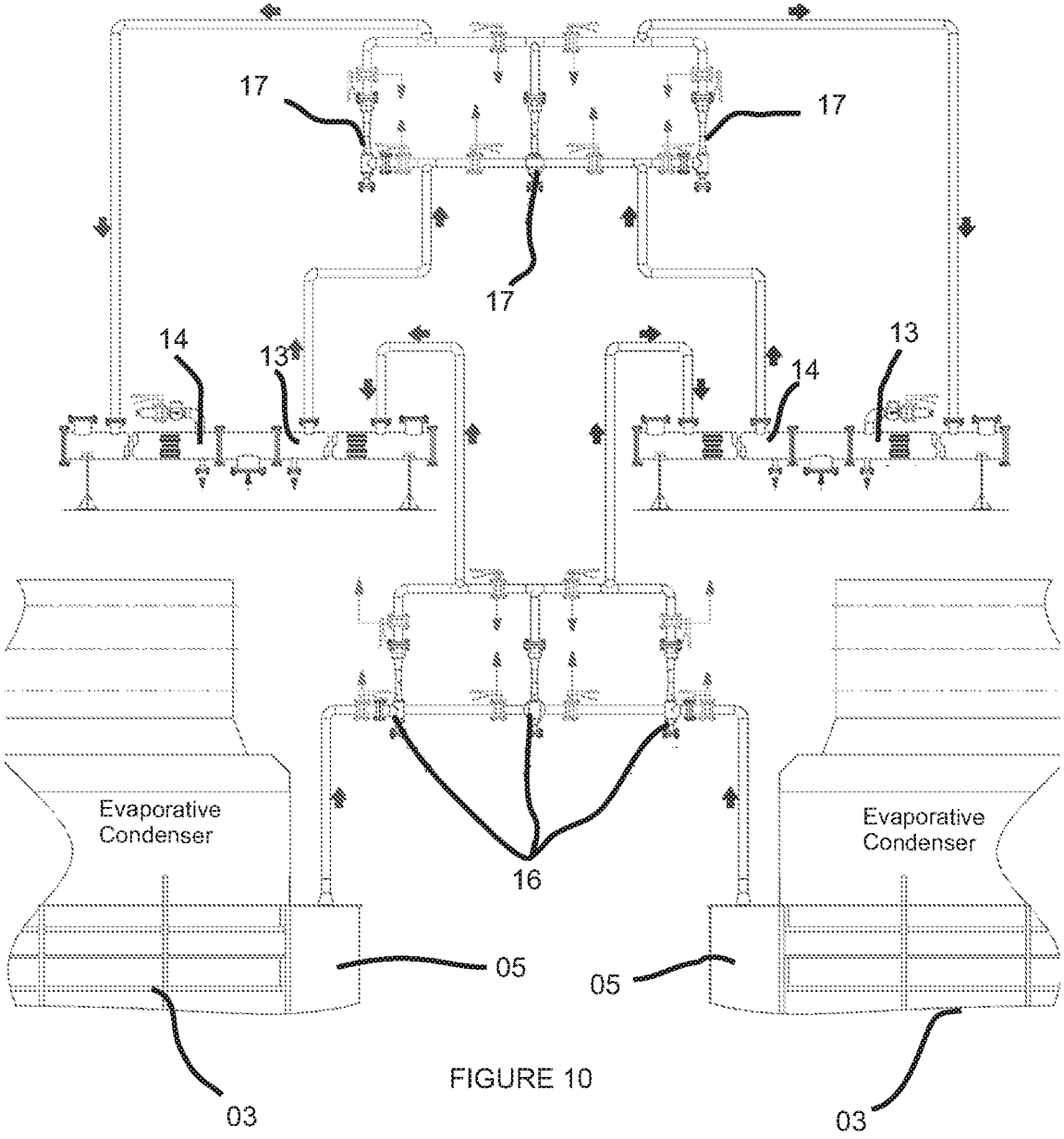
FIG. 10: detailed view of the air removal system demonstrating the ejectors of first and second stage.
Figure 11:
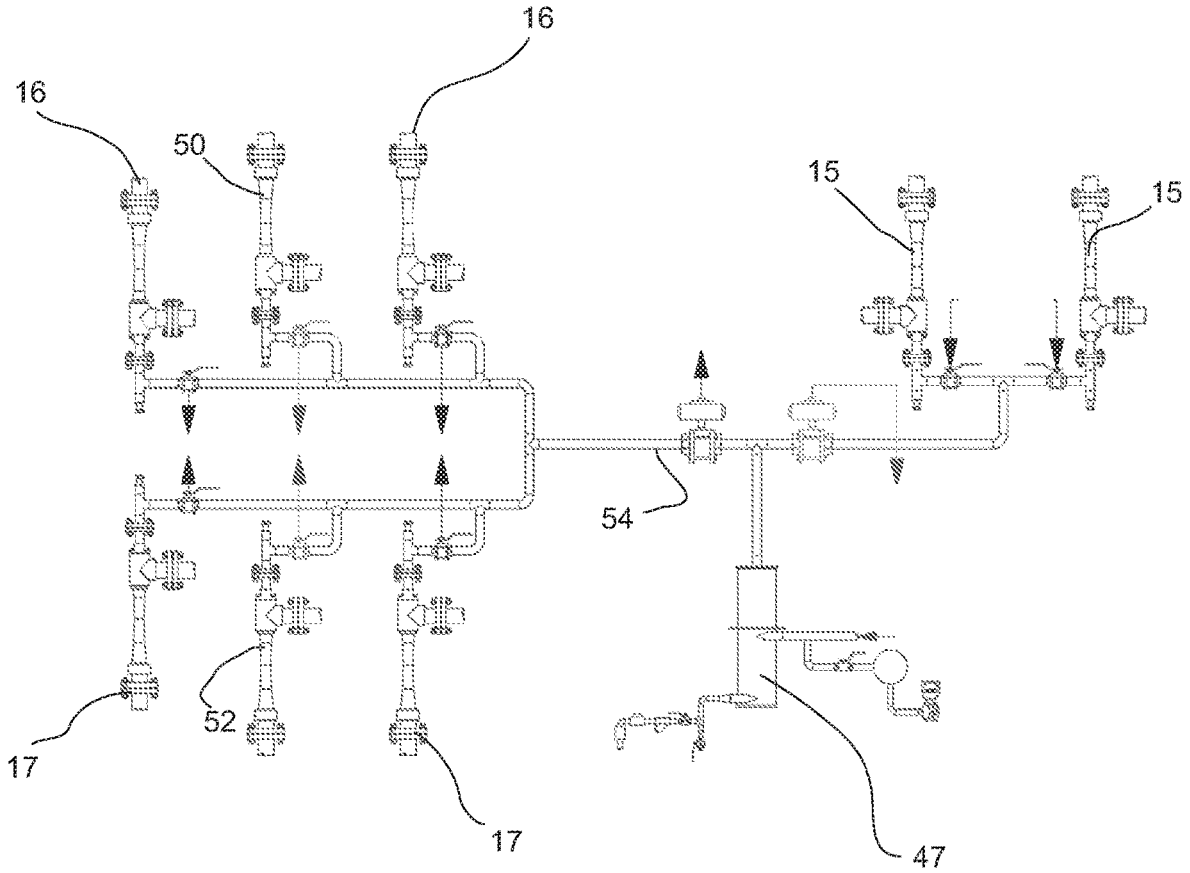

As it can be inferred from the accompanying drawings that are an integral part of this description invention patent it is revealed in this document a VACUUM CONDENSATION SYSTEM BY USING EVAPORATIVE CONDENSER AND AIR REMOVAL SYSTEM COUPLED TO CONDENSING TURBINES IN THERMOELECTRIC PLANTS preferably made of stainless steel, metal alloys and other materials. This condensation system is basically composed of an exhaust steam collector (02), a steam duct (01), an evaporative condenser (03) and ejectors (15, 16, 17) with ejectors condensers (13, 14). The operation of the system for energy cogeneration begins with the burning of bagasse of the sugarcane in boilers that produce high-pressure steam. This steam is injected in the turbine to move the rotors and produce electricity. The exhaust steam that that comes off the turbine is collected by the steam collector and is routed to the evaporative condenser for condensation and the condensate formed is pumped to power the boiler as shown in FIG. 2.

The steam produced in the high-pressure boilers is sent to the turbines moving the rotors attached to the axle that generates mechanical energy. In the turbine axle there is a generator that converts mechanical energy into electrical energy. Since the rotors are positioned in sequential operation on the turbine from the first (input of high pressure steam) to the last (exit of the steam to the condensing system) the vacuum created by the system follows the flow of the steam, thus ensuring lower pressure in the last rotors. In this last stage the rotors of a condensing turbine are designed to work with low pressure steam. For better description the system causes the pressure inside the turbine to change from positive to negative in the last condensation stage of the turbine. The temperature of condensation at atmospheric pressure is 100° C. while the condensation temperature in a vacuum with 0.11 bar (or smaller) is 48° C.

The steam duct (01) suspended by supports (22) collects the exhaust steam from the condensing turbine through the steam collector (02) using the second law of thermodynamics: For the steam to produce work, it is necessary to have a differential of temperature and pressure. The exhaust steam already at low pressure is led to the evaporative condenser (03), where happens the transformation of steam into condensed water which is again done with the aid of the recirculating water. The turbine exhaust steam passes through the duct (01) and is distributed through distribution ducts (04) in the steam input chamber (05), distributed in the tubular pipe bundles (41) and drained at the bottom of the steam exit chambers (08) of the evaporative condenser (03).

The condensate of this steam is drained on the base (24) of the exit chamber (08) of the evaporative condenser (03) and stored in the condensate tank (27). The condensate tank (27) serves as a condensate reservoir that is pumped by pumps (31) for the turbine cycle. The condensate tank (27) is suspended on a base (29) and receives condensed water from the entire vacuum condensation system by the pipes (28). More specifically it receives the condensed water from the duct exhaust steam (01), condensate of the evaporative condenser (03), steam condensate from the intermediate condenser (13) and the trap condensate (67) of the steam separator (47).

The system has pipes (71, 72, 73, 74) that discards the condensate from the evaporative condenser (03), intermediate condenser (13), a steam separator (47) and a steam duct (01) in the tank (27). These pipes of condensate discharge should be submerged in the tank, that is, it must have a minimum level of water in the condensate tank to keep the pipes immersed and not break the vacuum.

The water of the condensate tank (27) can be withdrawn by two pumps of condensate (31) connected by piping (30), during the operation a pump is turned on and the other remains as a reserve. The condensate level in the tank is controlled by a level transmitter installed on the bottom of the tank (27) and a control valve in the exit line. When the condensate level reaches the lowest point, the valve closes and when the condensate level begins to reach a higher point, the valve opens. When the level reaches the top edge it triggers the level switch. To help lower the tank level, the condensate pump (31), that was standing by, is turned on, and that status is maintained until the level is lowered. The condensate pumps (31) are sealed with external water, for safety one actuated valve is placed in the water input ensuring that no pump will turn on when the valve is closed. In the water input of the seal of each pump has a manual valve, it should remain open.

All the steam condensate in the duct (01) should be taken out ensuring that it does not return to the turbine. The condensate is removed through drains (33) in the lower part of the duct (01), in this area there is a level monitoring point and for safety two more monitoring points (34, 35) are installed in the duct (01). The system redundancy with the installation of three level instruments serves to ensure that the operator is informed and that the action be taken.

The system has a security control that prevents the turbine operation with a high level of condensate in the duct, thereby preventing the arrival of liquid in the turbine rotors. This system is composed by a level transmitter (36) and a level switch which monitors the level in the duct. If it reaches the level of the first key (high attention level), the operator will be notified in order to check the operation of the drainage system in the duct (pumps). If the level continues to rise and reaches the second key (operating emergency level) the operator is alerted that the turbine steam supply will be shut down in "X" seconds and the whole system will shut to protect the condensate return to the turbine. The system will be stopped until all the condensate is removed from the duct and the drainage system checked.

The system main component is the evaporative condenser (03), a device that uses thermodynamic principles to accomplish the condensation of turbine exhaust steam and generate vacuum in the rotor in the last stage of the turbine. The main components of the evaporative condenser are exhaust heated air (10), steam chambers (05, 08), bundle of tubes (41), condensate tank (27), filter (44), recirculation pumps (46) spray nozzles (40) of water, troughs (76), grid for mist elimination (92), baffles (06), support (09) and access platform (68).

This condenser (03) has a constructive and operational improvement. Constructively this equipment was perfected to condense by vacuum the turbine exhaust steam via a tubular bundle system (41) cooled by the joint action of the air current produced by the exhauster (10) and the water spray by the nozzles (40) forming the physical effect of wet bulb temperature. The turbine exhaust steam is led through the steam duct and distributed through the distributor duct in the steam input chamber (05) and distributed in tube bundles (41) of the evaporative condenser (03). On the tube bundle (41) there is a set of nozzles sprays (40) which spray water on the outer surface of the tubes (90) through the water curtain where there is a flow of air moved by the exhauster (10) which cools the water to the wet bulb temperature. The steam in contact with the cooled wall of the tube undergoes condensation, and this condensate moves to the steam exit chambers, at the bottom there is a drain to remove this condensate and forwards it to a reservoir (27) of condensed water. It is worth noting that the turbine exhaust steam condensed inside the tubular pipe bundle circulates only inside the beams and the cooling water responsible for cooling the tubes have no direct contact with the vapor to be condensed. This evaporative condenser is symmetrically equal, it has two tube bundles (41), two spraying systems (40), triangular troughs (91), trough or cooling water reservoir (76) positioned at opposite sides.

The condenser (03) has an exhauster (10) moved by an electric motor (12) that drives the propeller (18) and moves the air forming an air flow in the center of the evaporative condenser (03), which exhausted the heat away from the equipment. This movement of air along with the water spray on the tubular bundle (41) promotes the condensing effect using the wet bulb temperature. For this exhaust not to drag the water the evaporative condenser has a screen which eliminates the drag of the drops.

The recirculation system wets the tube bundles (41) of the condenser and the incondensable are removed by the ejector (air), thereby maintaining the vacuum in the system which propagates to the rotors of the vacuum condensation turbines. In this condensing system the ejectors (15, 16, 17) are positioned on top of the evaporative condenser. They remove the air as a way to make exchange of heat more efficient, since the air gases are incondensable.

The system of spray nozzles (40) (sprays) receives water from the pump (46) of recirculation stored in the trough (76) and drains by pipe (78) positioned on the condenser base (03). This water from the evaporative condenser trough is continuously recirculated to maintain the outer wall of the tubes wet (93). The recirculation is done by pumping the water to the nozzles (40) above the tubular bundles. The recirculation pump receives the water from the troughs (76, 75) goes through the pipe (45) that pass inside the intermediate (13) and final (14) condenser, from this the water exits and goes to the set of spray nozzles (40) forming a curtain of water over the tubes. This recirculation of water is utilized to cool the interior of the intermediate (13) and final (14) condenser to condense the driving steam of the ejector that is together with air and is discarded by the ejectors (15, 16, 17).

This water sprayed over the hot tubes (93) along with the air movements promotes the evaporation of part of this cooling water which is constantly replenished in accordance with the level of the water troughs (76). This water control is performed by a level transmitter (43) which detects the level of the trough (76) and by the modulation of the replacement water input control valve (42) to maintain the water level according to the desired level. This replacement of water is calculated according to the amount evaporated being 1:1, that is, for every 75 t/h of steam condensate it is necessary to replace 75 t/h of water. Comparing with conventional condensing systems it is necessary to replace less amount of water.

To prevent debris from being thrown in the spray nozzles (40) causing clogging it is installed a filter (44) in the suction of the recirculation pump (46). It is recommended to open the valve of the recirculation pump filter (46) at least once a day for a short period of time, to remove the dirt lying inside the filter (44). If is necessary to replace the water of the condenser (03) it should be opened the drain located at the bottom of the trough (76) or by the filter valve (44) of the recirculation pump (46) eliminating all the water.

Another advantage of this system is the fact that the air removal is performed with ejectors (15, 16, 17) causing an energy saving compared with systems that utilize vacuum pump, since the ejectors operate with high pressure steam and the pumps operate consuming electricity. Intermediate condenser (13) and the Final Condenser (14) are essential for the air removal system because two thrusters working in sequence to achieve the operating vacuum is necessary to place between the ejectors a condenser (13); whose function is to condense the steam which is disposed by the $1^{st}$ stage ejector (16), and then for the $2^{nd}$ ejector (17) to suck only air. The condensed vapor in the intermediate condenser (13) is discarded on the condensate tank (27) and the final condenser (14) is discarded in the troughs (76) of the evaporative condenser (03).

The ejectors (15, 16, 17) have the function of removing incondensable gases (air) from the system, this is done by high pressure steam passing through the nozzle that causes the decrease of the static pressure, thus dragging out the air from the equipment. The system mentioned in this document consists of one Starting Ejector (15), one $1^{st}$ Stage Ejector (16) and a $2^{nd}$ Stage Ejector (17) it may or may not have Reserve Ejectors (50, 52). As they are represented in the figures, the ejectors have a steam input, an air input, an air and steam exit and a nozzle that operate to remove the air from the system.

The $1^{st}$ Stage Ejector (16), 2nd Stage (17) and Starting Ejector (15) have different characteristics, as follows:

Starting Ejector (15): It is characterized by a greater flow of air, but it can't reach the operating vacuum, so it is used only at the start of the condenser and then it closes.

1st Stage Ejector (16): with a smaller air flow, but capable of reaching the operating vacuum when working together with the 2nd stage ejector, the $1^{st}$ stage ejector is responsible for removing all the air from the Evaporative Condenser Chamber and discard it in the intermediate condenser.

2nd Stage Ejector (17): with a smaller air flow, but with the capability of achieving the vacuum operation, it just sucks the air ejected by the 1st Stage Ejector and discards it at the final condenser (atmosphere).

The system also has a steam separator (47) that separates the steam from the condensed before powering up the ejectors (15, 16, 17). The steam separator (47) is composed of the following items: Steam Separator's body that is used to separate debris that are in the pipeline and in the steam condensate; Steam Entry; Steam Exit for the ejectors; Exit of the condensate for the condensate tank; Drain Valve; Pressure Transmitter shut-off Valve; Pressure Transmitter seal tank; Pressure transmitter is used to monitor the steam pressure in the input line; Condensate exit Lock valve; Y filter used to protect the dirt trap from the trap system.

The steam power up of the ejectors (15, 16, 17) is directed by the separator (47) and pipes (54) until the ejectors. The steam goes two ways, one way it powers up the Starting Ejectors (15) and the other it powers up the $1^{st}$ Stage (16) and 2nd Stage (17) Ejectors.

As shown in the figures this constructive arrangement of the ejectors (15, 16, 17) has an autonomously input steam system, when triggered to perform vacuum during the start it releases steam for the Start Ejectors (15) 1 ° Stage (16) and 2nd Stage (17) and when it reaches the starting vacuum (close to operation vacuum) blocks the steam entrance to the Start Ejectors (15).

Each ejector (15, 16, 17) has a manual valve in the steam input, which is used for system maintenance.

For system air removed in the beginning of the process it is used the Start Ejectors (15) that has a greater air flow.

The suction of the $1^{st}$ Stage Ejector (16) is connected to the exit steam chambers of the evaporative condenser to remove air from the system and discard in the intermediate condenser (13), the $2^{nd}$ Stage Ejector (17) is responsible for removing only the air from the intermediate condenser (13)

and discarding in the final condenser (14) and all the air of the final condenser (14) exits to the atmosphere through the silencer (19).

As shown in the vacuum condensing system the air removal and the pressure of each evaporative condenser (03) is monitored and controlled with the aid of a vacuum meter and an absolute pressure transmitter.

For all that it was shown this invention patent document refers to a vacuum condensing system that may be designed and manufactured with different sizes and capacities.

The invention claimed is:

1. A vacuum condensation system coupled to a condensing turbine in a thermoelectric plant, the vacuum condensation system comprising:

an exhaust steam collector, a steam duct suspended by supports, an evaporative condenser having distribution ducts, steam input chambers, tubular pipe bundles, steam exit chambers, and spray nozzles positioned above the tubular pipe bundles, the spray nozzles receiving water from a recirculation pump stored in a trough positioned on a base of the evaporative condenser, ejectors, ejector condensers comprising an intermediate condenser and a final condenser, a steam separator, a condensate tank suspended on a base and serving as a condensate reservoir, and two pumps connected to the condensate tank by piping for withdrawing condensate from the condensate tank for a turbine cycle;

wherein the steam duct collects exhaust steam at low pressure from the condensing turbine through the exhaust steam collector and leads the exhaust steam to the evaporative condenser, where the exhaust steam is condensed using recirculating water; the exhaust steam passes through the steam duct and is distributed by the distribution ducts into the steam input chambers and further distributed in the tubular pipe bundles, and condensate of the exhaust steam is drained at a bottom of the steam exit chambers of the evaporative condenser and stored in the condensate tank;

the vacuum condensation system further comprising pipes that discard condensate from the evaporative condenser, the intermediate condenser, the steam separator, and the steam duct into the condensate tank, wherein the condensate tank receives condensate from the entire vacuum condensation system, including condensate from the steam duct, condensate of the evaporative condenser, steam condensate from the intermediate condenser, and a trap condensate of the steam separator; wherein the steam duct comprises a level monitor and two additional level monitors at a lower part of the steam duct, and all the condensate is removed through drains in the lower part of the steam duct, wherein the vacuum condensation system is formed from stainless steel, and wherein the recirculation pump receives water from the trough and delivers the water through a pipe that passes inside the intermediate condenser and the final condenser before the water goes to the spray nozzles forming a curtain of water over the tubular pipe bundles, thereby cooling the interior of the intermediate condenser and the final condenser to condense driving steam of the ejectors that is together with air and is discarded by the ejectors.

2. The vacuum condensation system according to claim 1, wherein the evaporative condenser further comprises a heated air exhauster having a propeller, a filter, a grid for mist elimination, baffles, a support and an access platform; wherein an electric motor drives the propeller to move air forming an air flow in the center of the evaporative condenser to thereby exhaust heat.

3. The vacuum condensation system according to claim 1, wherein the recirculation pump and the spray nozzles wet the tubular pipe bundles of the evaporative condenser, and wherein the ejectors remove incondensable gases, thereby maintaining a vacuum in the system which propagates to rotors of the condensing turbine.

4. The vacuum condensation system according to claim 1, further comprising a filter installed in the suction of the recirculation pump to prevent debris from clogging the spray nozzles.

5. The vacuum condensation system according to claim 1, wherein the ejectors remove air.

6. The vacuum condensation system according to claim 1, wherein the steam separator separates steam from condensate before powering up the ejectors.

* * * * *